United States Patent [19]

Surletta

[11] Patent Number: 4,657,231

[45] Date of Patent: Apr. 14, 1987

[54] FURNITURE SPRING ASSEMBLY HAVING FRAME SUPPORT

[75] Inventor: Zygmunt M. Surletta, East Detroit, Mich.

[73] Assignee: Lear Siegler, Inc., Berkley, Mich.

[21] Appl. No.: 848,407

[22] Filed: Apr. 4, 1986

[51] Int. Cl.[4] ..... F16F 3/02

[52] U.S. Cl. ..... 267/107; 5/247; 267/110

[58] Field of Search ..... 5/247, 255; 267/102, 267/103, 106, 107, 110

[56] References Cited

U.S. PATENT DOCUMENTS

| | | | |
|---|---|---|---|
| 2,684,844 | 7/1954 | Flint et al. . | |
| 2,719,578 | 10/1955 | Flint . | |
| 2,764,227 | 9/1956 | Williams et al. . | |
| 2,835,316 | 5/1958 | Neely | 267/107 X |
| 2,855,984 | 10/1958 | Majorana et al. . | |
| 2,910,115 | 10/1959 | Meyers | 267/107 |
| 3,087,719 | 4/1963 | Flint | 267/107 X |
| 4,228,991 | 10/1980 | Crosby | 267/110 |
| 4,364,547 | 12/1982 | Crosby | 267/110 |

FOREIGN PATENT DOCUMENTS

| | | | |
|---|---|---|---|
| 872493 | 7/1961 | United Kingdom | 267/107 |

*Primary Examiner*—Duane A. Reger

*Attorney, Agent, or Firm*—Brooks & Kushman

[57] ABSTRACT

A furniture spring assembly (10,10',10'') provides support for a torsion bar spring (16) between spaced frame members (12,14). An elongated support (44) of the spring assembly extends from a fishmouth torsion bar (22) at a frame mounted end (18) of the spring (16) to a foot (42) at the other spring end (38) and then for connection to the other frame member (14). Each of three preferred embodiments of the elongated support preferably includes a helical spring (71) that provides the connection thereof to the frame member (14). One embodiment of the support (44) includes an elongated metal strip (72) having a first end (74) hooked to the fishmouth torsion bar (22) and having a second end (76) including an attachment flange (80) and an attachment loop (82) that are secured to the foot (42) of the second spring end. Another embodiment of the support (44) includes an elongated metal strip (83) having a first hooked end (84) that receives the fishmouth torsion bar (22) and a second end (86) that extends through the foot (42) of the second spring end (38) with an attachment flange (88) providing the securement. A third embodiment of the support (44) includes a wire connector (90) having a first end with a hook (98) that receives the fishmouth torsion bar (22) and a second end with terminal hooks (100) secured to the foot (42) of the second spring end (38) to cooperate with a second connector (96) that is also hooked thereto to provide the securement to the frame member (14).

24 Claims, 6 Drawing Figures

FURNITURE SPRING ASSEMBLY HAVING FRAME SUPPORT

TECHNICAL FIELD

This invention relates to a support for mounting a furniture spring assembly of the torsion bar type on the frame of an article of furniture.

BACKGROUND ART

Torsion bar springs have been used for many years to provide support to an individual seated on the article of furniture with which the spring assembly is utilized. Conventionally such torsion bar springs include torsion bars connected by spacer bars of either a straight or curved shape, the former of which is conventionally referred to as a "formed wire" spring while the latter of which is conventionally referred to as a "sinuous" spring. Both formed wire and sinuous springs often include a fishmouth section at one or both ends of the spring. Such fishmouth sections have a generally V-shaped configuration with a torsion bar at the apex and a pair of spacer bars extending from opposite ends of the apex torsion bar.

In order to provide spring reinforcement, torsion bar springs have previously incorporated braces extending from the apex torsion bar of a fishmouth section to another portion of the spring. Such constructions are disclosed by U.S. Pat. Nos.: 2,684,844 Flint et al, 2,719,578 Flint, 2,764,227 Williams et al, and 2,855,984 Majorana et al.

The U.S. Pat. No. 4,228,991 of Crosby discloses a furniture seat spring assembly including a torsion bar spring whose opposite ends are mounted on top of a sinuous spring that extends between a pair of spaced frame members of the frame of an article of furniture. Both ends of the torsion bar spring have attachment sections from which associated ramp sections extend upwardly at an inclined orientation to an intermediate spring portion extending between the ramp sections.

DISCLOSURE OF INVENTION

An object of the present invention is to provide an improved furniture spring assembly for mounting a torsion bar spring between first and second spaced frame members of an article of furniture.

In carrying out the above object, the furniture spring assembly of the invention includes a torsion bar spring having a first end including a fishmouth section with a generally V-shaped configuration. This fishmouth section includes a torsion bar and a pair of spacer bars extending from the torsion bar to provide its V-shaped configuration. One of the spacer bars has a foot that defines a terminal end of the torsion bar spring and provides for mounting thereof directly on the first frame member. The torsion bar spring also includes an intermediate portion having a first end connected to the other spacer bar of the fishmouth section and having a second end spaced from the fishmouth section. The torsion bar spring has a second end connected to the second end of the intermediate spring portion and has a foot that defines another terminal end of the torsion bar spring and provides for its mounting. A support of the furniture spring assembly extends from the torsion bar of the fishmouth section at the first end of the spring to the foot at the second end thereof and thence for mounting on the second frame member.

The furniture spring assembly has particular utility for use as a furniture seat bottom with the fishmouth section located at the front frame member. However, it should be appreciated that the furniture spring assembly can also be utilized with a seat back extending between upper and lower frame members. In the later case, the fishmouth section is located at the upper frame member and the support providing the mounting of the second spring end is located adjacent the lower frame member.

In each preferred embodiment disclosed, the support of the furniture spring assembly includes a helical spring for providing tensioning thereof in mounting the torsion bar spring on the spaced frame members. The second end of the torsion bar spring in each embodiment includes an extension that extends therefrom toward the second frame member at a location adjacent the helical spring of the support. Also, the second end of the torsion bar spring in each embodiment includes an end torsion bar and a terminal foot bar utilized in the mounting of the torsion bar spring by the support which extends from the fishmouth section to the remote frame member.

In each of two of the preferred embodiments of the spring assembly, the support is constructed as an elongated metal strip having a first hooked end that receives the torsion bar of the fishmouth section to provide securement of the support to the fishmouth section. The elongated metal strip has a second end that mounts the foot of the second spring end and is secured to the helical spring of the support to provide the attachment thereof to the second frame member in a tension manner.

In one of the metal strip embodiments of the support, the second end of the elongated metal strip includes an attachment flange and an attachment loop for respectively receiving the end torsion bar and the terminal foot bar of the foot of the second spring end to provide the mounting of the second spring end. In this embodiment, the elongated metal strip engages the foot of the second spring end on the opposite side thereof as the intermediate portion of the torsion bar spring. Both the attachment flange and the attachment loop of the second end of the elongated metal strip extend toward the intermediate portion of the torsion bar spring to respectively receive and secure the end torsion bar and the terminal foot bar of the foot on the second spring end. The first hooked end of the elongated metal strip in this embodiment also extends toward the intermediate portion of the torsion bar spring to receive the torsion bar of the fishmouth section. Providing the attachment flange, the attachment loop, and the first hooked end extending in the same direction toward the intermediate portion of the torsion bar spring facilitates manufacturing of the elongated metal support by a punch forming operation.

In the other metal strip embodiment, the second end of the elongated metal strip extends through the foot of the second spring end on one side of the end torsion bar with respect to the intermediate spring portion and on the other side of the terminal foot bar with respect to the intermediate spring portion. Most preferably, the second end of the elongated metal strip in this embodiment is located on the side of the end torsion bar toward the intermediate spring portion and on the side of the terminal foot bar away from the intermediate spring portion. The second end of the elongated metal strip of this embodiment also preferably includes an attachment flange that receives and secures one of the bars of the foot of the second spring end. This securement by the attachment flange is preferably provided by securing the end torsion bar of the foot of the second spring end. Both the first hooked end of the elongated metal strip and the attachment flange of this embodiment extend away from the intermediate torsion bar of the spring to respectively receive the torsion bar of the fishmouth section and the end torsion bar of the foot of the second spring end. This construction of the elongated metal strip with the first hooked end and attachment flange of the elongated metal strip extending in the same direction away from the intermediate portion of the torsion bar spring facilitates manufacturing thereof by a punch forming operation.

Another embodiment of the support includes an elongated wire connector having a first end connected to the torsion bar of the fishmouth section and having a second end connected to the foot of the second spring end. The support of this embodiment also includes a second connector that extends from the foot of the second spring end to the helical spring. The second end of the wire connector and the second connector are each preferably connected to the end torsion bar of the foot of the second spring end. The wire connector embodiment of the support preferably has a unitary construction bent from a single length of wire. This unitary wire connector includes an intermediate hook that defines the first end of the wire connector and is hooked over the torsion bar of the fishmouth section. The single length of wire also has a pair of terminal hooks that define the second end of the wire connector and are hooked over the end torsion bar of the foot of the second spring end.

The embodiment of the support including the wire connector has its second connector provided with a hook that is hooked over the end torsion bar of the foot of the second spring end between the pair of terminal hooks of the second end of the wire connector. The intermediate hook portion at the first end of the wire connector and the pair of terminal hooks at the second end of the wire connector extend in the same direction with respect to the intermediate spring portion to receive and secure the associated torsion bars of the torsion bar spring. The hook of the second connector in this embodiment preferably extends toward the intermediate portion of the torsion bar spring to receive the end torsion bar of the foot of the second spring end, and the second connector extends on the side of the terminal foot bar of the foot of the second spring end in a direction away from the intermediate spring portion to provide support of the foot of the second spring end.

The objects, features, and advantages of the present invention are readily apparent from the following detailed description of the best modes for carrying out the invention when taken in connection with the accompanying drawings.

BEST MODES FOR CARRYING OUT THE INVENTION

Figure 1:
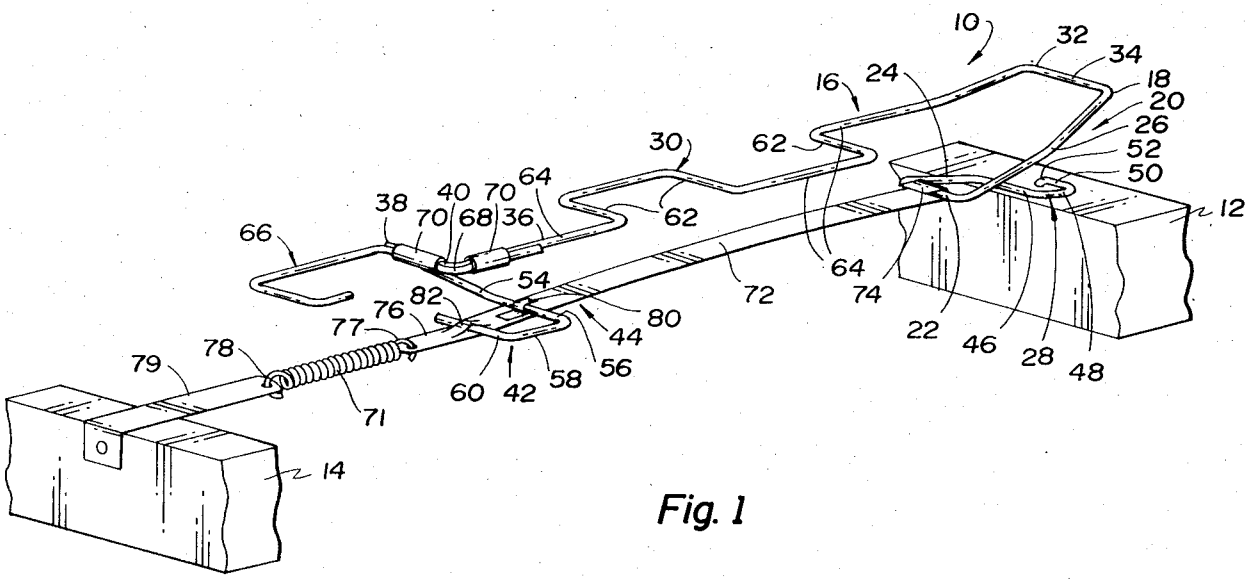
FIG. 1 is a perspective view of one embodiment of a furniture spring assembly constructed in accordance with the present invention.

With reference to FIG. 1 of the drawings, one embodiment of a furniture spring assembly constructed in accordance with the present invention is generally indicated by 10 and functions to provide support between first and second spaced frame members 12 and 14 of an article of furniture. As illustrated, the furniture spring assembly is used as part of a seat bottom extending between horizontally spaced frame members with the frame member 12 functioning as the front frame member and the frame member 14 functioning as the rear frame member. However, it should be appreciated that the furniture spring assembly of this invention can also be utilized as part of a seat back extending between upper and lower frame members, in which case, the orientation of the spring assembly will be such that its end adjacent the frame member 12 illustrated would be at the upper location and its end adjacent the frame member 14 would be at the lower location. Nevertheless, the furniture spring assembly 10 does have particular utility for use as part of a seat bottom of an article of furniture as is hereinafter more fully described.

With continuing reference to FIG. 1, the furniture spring assembly 10 illustrated includes a torsion bar spring 16 having a first end 18 including a fishmouth section 20 of a generally V-shaped configuration when viewed from a sideways direction. This fishmouth section 20 includes a torsion bar 22 and a pair of spacer bars 24 and 26 extending from opposite ends of the torsion bar 22 to provide the V-shaped configuration of the fishmouth section. The one spacer bar 24 has a foot 28 that defines a terminal end of the torsion bar spring and provides for mounting thereof directly on the first frame member 12 as is hereinafter more fully described. An intermediate portion 30 of the spring 16 has a first end 32 connected by a torsion bar 34 to the other spacer bar 26 which extends from the opposite end of the fishmouth torsion bar as the other spacer bar 24. A second end 36 of the intermediate spring portion 30 is spaced from the first end 32 thereof toward the second frame member 14 in the assembled relationship shown. Torsion bar spring 16 has a second end 38 connected to the second end 36 of the intermediate spring portion 30 by a torsion bar 40. This second spring end 38 has a foot 42 that defines another terminal end of the torsion bar spring and provides for mounting thereof in the assembled relationship shown. A support of the spring assembly is generally indicated by reference numeral 44 and extends from the torsion bar 22 of the fishmouth section 20 at the first end 18 of the spring 16 to the foot 42 at the second spring end 38 and thence to the second frame member 14 for mounting thereon as shown.

As illustrated in FIG. 1, the foot 28 of the first spring end 18 includes an end torsion bar 46 extending from the one spacer bar 24 in a perpendicular relationship, a foot spacer bar 48 extending from the end torsion bar 46 in a perpendicular relationship, a terminal end bar 50 extending in a perpendicular relationship from the foot spacer bar 48, and a mounting prong 52 that defines the one terminal end of the spring and is inserted into the frame member 12 to provide securement in the mounting thereof on the associated article of furniture. In the spring industry, the mounting prong 52 is conventionally referred to as a D-end and is utilized when stapling or other securement of the spring to the frame member does not provide sufficient strength in attaching the spring.

As also shown in FIG. 1, the second spring end 38 includes a spacer bar 54 extending downwardly from the torsion bar 40 to the foot 42 which is mounted by the support 44. However, it should be appreciated that the spacer bar 54 can be replaced with a fishmouth section if a greater height is needed. Foot 42 includes an end torsion bar 56 extending from the spacer bar 54 in a perpendicular relationship, a foot spacer bar 58 extending from the end torsion bar 56 in a perpendicular relationship, and a terminal end bar 60 extending from the foot spacer bar 58 in a perpendicular relationship and defining the other terminal end of the spring.

It should be noted that the intermediate spring portion 30 of the torsion bar spring is illustrated as being of the formed wire type including torsion bars 62 connected by associated spacer bars 64 in a perpendicular relationship. However, it is also possible to have the intermediate spring portion provided by sinuous wire including torsion bars connected by oppositely situated curved spacer bars, by torsion bars connected by diagonally extending spacer bars, or by a straight wire section as well as any other type of suitable formation. Also, the second spring end 38 may be provided with an extension 66 if a greater spring length is needed. This extension 66 has an L-shaped end 68 is secured by clips 70 to the adjacent torsion bar 40 and spacer bar 64.

Figure 2:
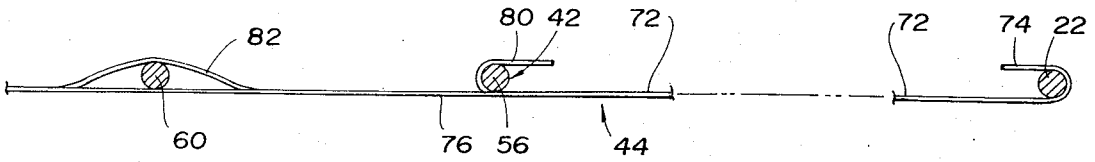
FIG. 2 is a partial broken away side view of the furniture spring assembly shown in FIG. 1 and illustrates the manner in which an elongated metal strip of a support of the assembly is attached to a torsion bar spring thereof to provide mounting of the spring.

The preferred construction of the support 44 illustrated in FIG. 1 includes a helical spring 71 for providing tensioning thereof and mounting the torsion bar spring on the spaced frame members 12 and 14. Support 44 is also illustrated as including an elongated metal strip 72 whose construction is shown in FIG. 2. This elongated metal strip 72 has a first hooked end 74 that receives the fishmouth torsion bar 22 to provide securement with respect to the fishmouth 20. The metal strip 72 has a second end 76 that mounts the foot 42 of the second spring end 38 and is secured to a hook 77 at one end of the helical spring 71. At its other end, the helical spring 71 includes a hook 78 that is secured to the frame member 14 by a retainer 79.

As illustrated by combined reference to FIGS. 1 and 2, the second end 76 of the elongated metal strip 72 includes an attachment flange 80 and an attachment loop 82 for respectively receiving the end torsion bar 56 and the terminal foot bar 60 of the foot 42 on the second spring end 38. The elongated metal strip engages the foot 42 of the second spring end on the lower side thereof which is on the opposite side as the intermediate spring portion 30 of the torsion bar spring. The attachment flange 80 and attachment loop 82 of the second end of the elongated metal strip 72 extend toward the intermediate portion 30 of the torsion bar spring to respectively receive and secure the end torsion bar 56 and terminal foot bar 60 of the foot 42 on the second spring end. The first hooked end 74 of the elongated metal strip 72 also extends toward the intermediate portion 30 of the torsion bar spring to receive the torsion bar 22 of the fishmouth section 20. This construction of the elongated metal strip with its first hooked end 74, its attachment flange 80, and its attachment loop 82 all extending toward the intermediate spring portion 30 illustrated in FIG. 1 facilitates manufacturing of the metal strip by a punching operation.

Figure 3:
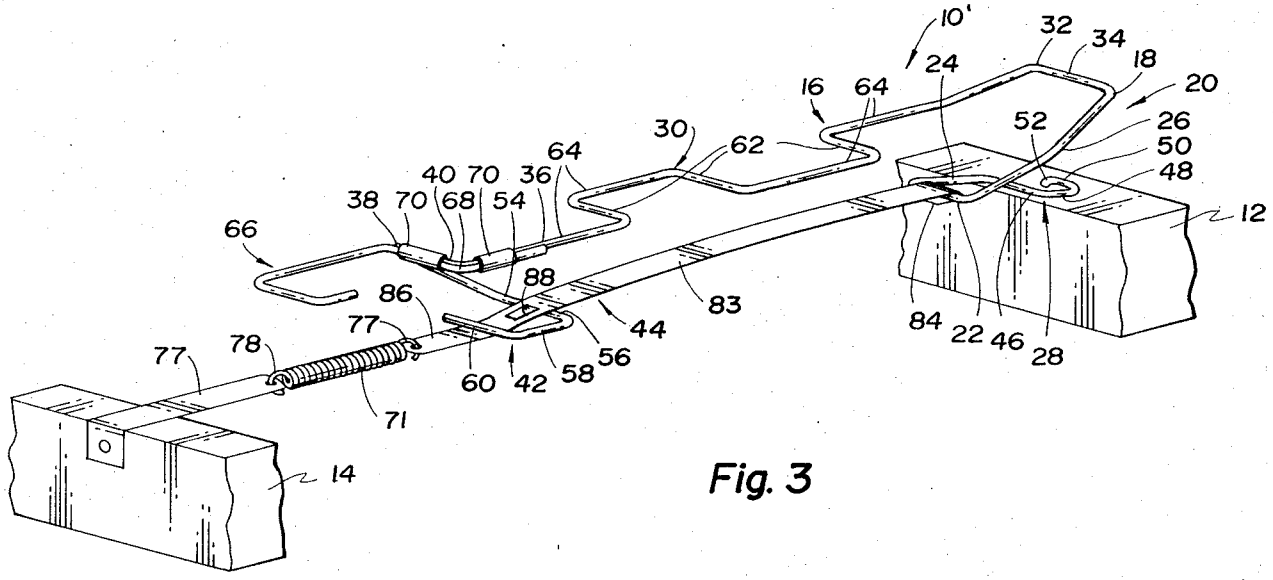
FIG. 3 is a perspective view of another embodiment of the furniture spring assembly which also includes an elongated metal strip support like the embodiment of FIGS. 1 and 2.

With reference to FIG. 3, another embodiment of the furniture spring assembly 10' includes a torsion bar spring 16 of a construction identical to the spring illustrated in FIG. 1 such that like reference numerals are applied thereto and no repetition of the description thereof is necessary. The support 44 of spring assembly 10' also includes an elongated metal strip 83 having a first hooked end 84 that receives the torsion bar fishmouth 22. The elongated metal strip 83 has a second end 86 that extends through the foot 42 on the second spring end 38 on one side of the end torsion bar 56 and on the other side of the terminal foot bar 60 with respect to the intermediate portion 30 of the torsion bar spring 16.

Figure 4:
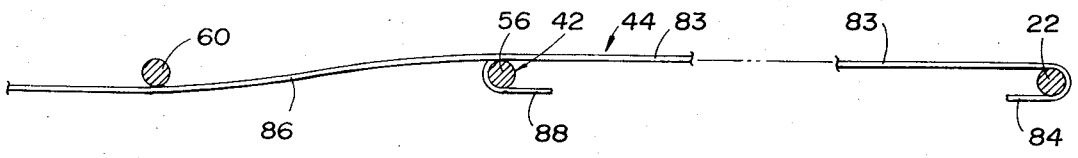
FIG. 4 is a partially broken away side view of the furniture spring assembly shown in FIG. 3 and illustrates the manner in which the metal strip is secured to the torsion bar spring of the assembly to provide its mounting.

The second end 86 of the elongated metal strip 83 preferably extends as illustrated in FIGS. 3 and 4 above the end torsion bar 56 which is in a direction toward the intermediate spring portion 30 and extends below the terminal foot bar 60 which is on the side thereof away from the intermediate spring portion 30 shown in FIG. 3. An attachment flange 88 of the second end 86 of the elongated metal strip 83 receives one of the bars 56,60 of the foot 42 of the second spring end 38. Most preferably, the attachment flange 88 receives and secures the end torsion bar 56 of the second spring end foot 42. Both the first hooked end 84 and the attachment flange 88 of the elongated metal strip 83 extend away from the intermediate portion 30 of the spring to respectively receive the torsion bar 22 of the fishmouth section 20 and the end torsion bar 56 of the foot 42 of the second spring end 38. This construction facilitates manufacturing of the elongated metal strip 83 by a punching operation. The second end 86 of the elongated metal strip 83 is secured to the adjacent frame member 14 by the helical spring 71 in the same manner as the previously described embodiment such that no repetition thereof is necessary. Adjacent the helical spring 71, the spring extension 66 also extends toward the frame member 14 to increase the effective support length of the spring.

Figure 5:
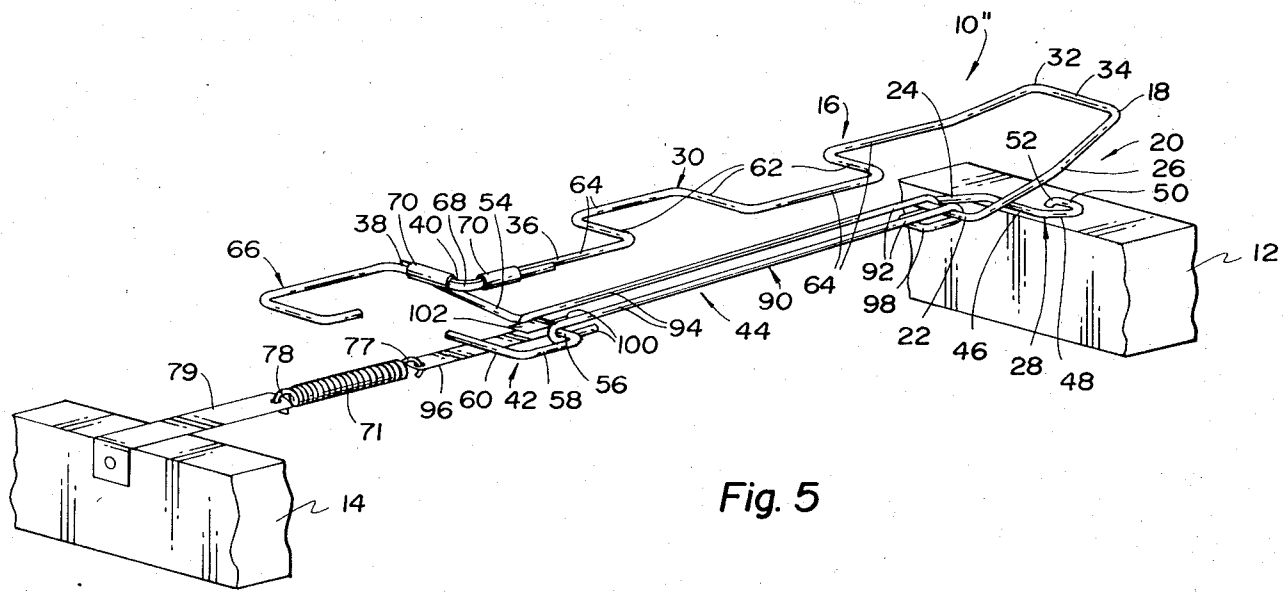
FIG. 5 is a perspective view of another embodiment of a furniture spring assembly constructed in accordance with the present invention and including a support having a wire connector for providing mounting of a torsion bar spring of the assembly in a manner similar to the previously described embodiments of the metal strip support.

With reference to FIG. 5, another embodiment of the furniture spring assembly is identified by 10'' and includes a torsion bar spring 16 of the same construction as the previously described embodiments such that like reference numerals are applied thereto and no further description thereof is necessary.

Figure 6:
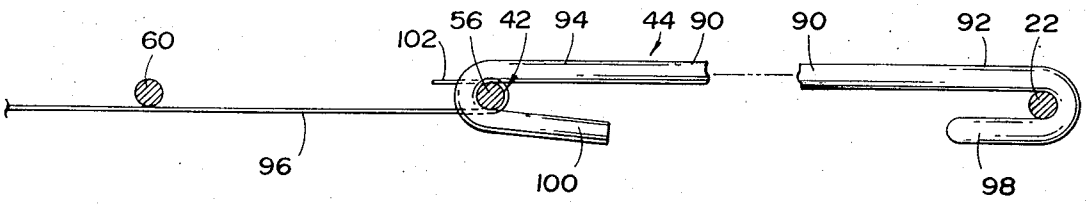
FIG. 6 is a partially broken away side view of the furniture spring assembly shown in FIG. 5 and illustrates the manner in which the wire connector and a second connector of the support provide mounting of the associated torsion bar spring.

As shown in FIGS. 5 and 6, the support 44 of the spring assembly 10'' includes an elongated wire connector 90 having a first end 92 connected to the torsion bar 22 of the fishmouth section 20 and having a second end 94 connected to the foot 42 of the second spring end 38. This support 44 also includes a second connector 96 that extends from the foot 42 of the second spring end 38 to the helical spring 71 for securement thereto and to the frame member 14 in the same manner previously described.

The preferred form of the wire connector 90 shown in FIGS. 5 and 6 has a unitary construction bent from a single length of wire and includes an intermediate hook 98 that defines the first end 92 of the wire connector and is hooked over the torsion bar 22 of the fishmouth section 20. The single length of wire also has a pair of terminal hooks 100 that define the second end 94 of the wire connector and are hooked over the end torsion bar 56 of the foot 42 of the second spring end 38. The second connector 96 has a hook 102 that is hooked over the end torsion bar 56 of the foot 42 of the second spring end 38 between the pair of terminal hooks 100 of the wire connector 90. Both the intermediate hook 98 at the first end 92 of the wire connector 90 and the pair of terminal hooks 100 at the second end 94 of the wire connector extend in the same direction with respect to the intermediate spring portion 30 to receive and secure the associated torsion bars 22 and 56 of the torsion bar spring 16. Such a construction facilitates the manufacturing of the wire connector.

As shown best in FIG. 6 with reference also to FIG. 5, the hook 102 of the second connector 96 extends toward the intermediate portion 30 of the torsion bar spring 16 to receive the end torsion bar 56 of the foot 42 of the second spring end 38. This second connector 96 also extends on the lower side of the terminal foot bar 60 of the foot 42 of the second spring 38 which is on the side thereof away from the intermediate spring portion 30 to provide support of the foot 42 of the second spring end 38. It should be noted that the second connector 96 is illustrated as a metal spring which is the preferred construction; however, it should be appreciated that other constructions can also be utilized such as, for example, a wire construction like the wire connector 90. Also, adjacent the second connector 96, the extension 66 of the spring 16 provides support toward the second frame member 14 in the same manner previously described.

While the best modes for carrying out the invention have been described in detail, those familiar with the art to which this invention relates will recognize various alternative designs and embodiments for practicing the invention as defined by the following claims.

What is claimed is:

1. A furniture spring assembly for providing support between first and second spaced frame members of an article of furniture, the furniture spring assembly comprising: a torsion bar spring having a first end including a fishmouth section having a generally V-shaped configuration; said fishmouth section including a torsion bar and a pair of spacer bars extending from the torsion bar to provide the V-shaped configuration of the fishmouth section; one of the spacer bars having a foot that defines a terminal end of the torsion bar spring and provides for mounting thereof directly on the first frame member; the torsion bar spring including an intermediate portion having a first end connected to the other spacer bar of the fishmouth section and having a second end spaced from the fishmouth section; the torsion bar spring having a second end connected to the second end of the intermediate spring portion and having a foot that defines another terminal end of the torsion bar spring and provides for mounting thereof; and a support extending from the torsion bar of the fishmouth section at the first end of the spring to the foot at the second end thereof and thence for mounting on the second frame member.

2. A spring assembly as in claim 1 wherein the support includes a helical spring for providing tensioning thereof in mounting the torsion bar spring on the spaced frame members.

3. A spring assembly as in claim 1 or 2 wherein the second spring end includes an extension that extends therefrom toward the second frame member.

4. A spring assembly as in claim 2 wherein the support comprises an elongated metal strip having a first hooked end that receives the torsion bar of the fishmouth section to provide securement thereto, and the elongated metal strip having a second end that mounts the foot of the second spring end and is secured to the helical spring to provide the attachment to the second frame member.

5. A spring assembly as in claim 4 wherein the foot of the second spring end includes an end torsion bar and a terminal foot bar, and the second end of the elongated metal strip of the support including an attachment flange and an attachment loop for respectively receiving the end torsion bar and the terminal foot bar of the foot on the second spring end to provide the mounting of the second spring end.

6. A spring assembly as in claim 5 wherein the elongated metal strip engages the foot of the second spring end on the opposite side thereof as the intermediate portion of the torsion bar spring, and the attachment flange and loop of the second end of the elongated metal strip extending toward the intermediate portion of the torsion bar spring to respectively receive and secure the end torsion bar and terminal foot bar of the foot on the second spring end.

7. A spring assembly as in claim 6 wherein the first hooked end of the elongated metal strip extends toward the intermediate portion of the torsion bar spring to receive the torsion bar of the fishmouth section.

8. A spring assembly as in claim 4 or 7 wherein the second spring end includes an extension that extends therefrom toward the second frame member.

9. A spring assembly as in claim 4 wherein the foot of the second end of the torsion bar spring includes an end torsion bar and a terminal foot bar, and the second end of the metal strip extending through the foot of the second spring end on one side of the end torsion bar with respect to the intermediate spring portion and on the other side of the terminal foot bar with respect to the intermediate spring portion.

10. A spring assembly as in claim 9 wherein the second end of the elongated metal strip is located on the side of the end torsion bar toward the intermediate spring portion and on the side of the terminal foot bar away from the intermediate spring portion.

11. A spring assembly as in claim 10 wherein the second end of the elongated metal strip includes an attachment flange that receives and secures one of the bars of the foot of the second spring end.

12. A spring assembly as in claim 11 wherein the attachment flange receives and secures the end torsion bar of the foot of the second spring end.

13. A spring assembly as in claim 12 wherein the first hooked end and the attachment flange of the elongated metal strip extend away from the intermediate portion of the torsion bar spring to respectively receive the torsion bar of the fishmouth section and the end torsion bar of the foot of the second spring end.

14. A spring assembly as in claim 9 or 13 wherein the second spring end includes an extension that extends therefrom toward the second frame member.

15. A spring assembly as in claim 2 wherein the foot of the second spring end includes an end torsion bar and a terminal foot bar, the support including an elongated wire connector having a first end connected to the torsion bar of the fishmouth section and having a second end connected to the foot of the second spring end, and the support also including a second connector that extends from the foot of the second spring end to the helical spring.

16. A spring assembly as in claim 15 wherein the second end of the wire connector and the second connector are each connected to the end torsion bar of the foot of the second spring end.

17. A spring assembly as in claim 16 wherein the wire connector has a unitary construction bent from a single length of wire and including an intermediate hook that defines the first end of the wire connector and is hooked over the torsion bar of the fishmouth section, the single length of wire having a pair of terminal hooks that define the second end of the wire connector and are hooked over the end torsion bar of the foot of the second spring end, and the second connector having a hook that is hooked over the end torsion bar of the foot of the second spring end between the pair of terminal hooks of the second end of the wire connector.

18. A spring assembly as in claim 17 wherein the intermediate hook at the first end of the wire connector and the pair of terminal hooks at the second end of the wire connector extend in the same direction with respect to the intermediate spring portion to receive and secure the associated torsion bars of the torsion bar spring.

19. A spring assembly as in claim 18 wherein the hook of the second connector extends toward the intermediate portion of the torsion bar spring to receive the end torsion bar of the foot of the second spring end, and the second connector extending on the side of the terminal foot bar of the foot of the second spring end in a direction away from the intermediate spring portion to provide support of the foot of the second spring end.

20. A spring assembly as in claim 15 or 19 wherein the second spring end includes an extension that extends therefrom toward the second frame member.

21. A furniture spring assembly for providing support between first and second spaced frame members of an article of furniture, the furniture spring assembly comprising: a torsion bar spring having a first end including a fishmouth section having a generally V-shaped configuration; said fishmouth section including a torsion bar and a pair of spacer bars extending from the torsion bar to provide the V-shaped configuration of the fishmouth section; one of the spacer bars having a foot that defines a terminal end of the torsion bar spring and provides for mounting thereof directly on the first frame member; the torsion bar spring including an intermediate portion having a first end connected to the other spacer bar of the fishmouth section and having a second end spaced from the fishmouth section; the torsion bar spring having a second end connected to the second end of the intermediate spring portion and having a foot that defines another terminal end of the torsion bar spring and provides for mounting thereof; a support including a metal strip having a first hooked end that receives the torsion bar of the fishmouth section at the first end of the spring; the metal strip of the support having a second end that supports the foot of the second end of the spring; and the support including a helical spring connected to the second end of the metal strip to provide connection thereof to the second frame member.

22. A furniture spring assembly for providing support between first and second spaced frame members of an article of furniture, the furniture spring assembly comprising: a torsion bar spring having a first end including a fishmouth section having a generally V-shaped configuration; said fishmouth section including a torsion bar and a pair of spacer bars extending from the torsion bar to provide the V-shaped configuration of the fishmouth section; one of the spacer bars having a foot that defines a terminal end of the torsion bar spring and provides for mounting thereof directly on the first frame member; the torsion bar spring including an intermediate portion having a first end connected to the other spacer bar of the fishmouth section and having a second end spaced from the fishmouth section and including an end torsion bar and a terminal foot bar; the torsion bar spring having a second end connected to the second end of the intermediate spring portion and having a foot that defines another terminal end of the torsion bar spring and provides for mounting thereof; a support including a metal strip having a first hooked end that receives the torsion bar of the fishmouth section at the first end of the spring; the metal strip of the support having a second end including an attachment flange and an attachment loop for respectively securing the end torsion bar and terminal foot bar of the foot of the second spring end; and the support including a helical spring connected to the second end of the metal strip to provide connection thereof to the second frame member.

23. A furniture spring assembly for providing support between first and second spaced frame members of an article of furniture, the furniture spring assembly comprising: a torsion bar spring having a first end including a fishmouth section having a generally V-shaped configuration; said fishmouth section including a torsion bar and a pair of spacer bars extending from the torsion bar to provide the V-shaped configuration of the fishmouth section; one of the spacer bars having a foot that defines a terminal end of the torsion bar spring and provides for mounting thereof directly on the first frame member; the torsion bar spring including an intermediate portion having a first end connected to the other spacer bar of the fishmouth section and having a second end spaced from the fishmouth section and including an end torsion bar and a terminal foot bar; the torsion bar spring having a second end connected to the second end of the intermediate spring portion and having a foot that defines another terminal end of the torsion bar spring and provides for mounting thereof; a support including a metal strip having a first hooked end that receives the torsion bar of the fishmouth section at the first end of the spring; the metal strip of the support extending through the terminal foot of the second spring end on one side of the end torsion bar thereof and on the opposite side of the terminal foot bar thereof with respect to the intermediate portion of the spring; the second end of the metal strip having an attachment flange that secures one of the bars of the foot on the second spring end; and the support including a helical spring connected to the second end of the metal strip to provide connection thereof to the second frame member.

24. A furniture spring assembly for providing support between first and second spaced frame members of an article of furniture, the furniture spring assembly comprising: a torsion bar spring having a first end including a fishmouth section having a generally V-shaped configuration; said fishmouth section including a torsion bar and a pair of spacer bars extending from the torsion bar to provide the V-shaped configuration of the fishmouth section; one of the spacer bars having a foot that defines a terminal end of the torsion bar spring and provides for mounting thereof directly on the first member; the torsion bar spring including an intermediate portion having a first end connected to the other spacer bar of the fishmouth section and having a second end spaced from the fishmouth section and including an end torsion bar and a terminal foot bar; the torsion bar spring having a second end connected to the second end of the intermediate spring portion and having a foot that defines another terminal end of the torsion bar spring and provides for mounting thereof; a support including an elongated wire connector having a first hooked end that receives the torsion bar of the fishmouth section at the first end of the spring; the wire connector having a second hooked end that receives the end torsion bar of the foot on the second spring end; and the support also having a second connector including a metal strip hooked to the end torsion bar of the foot on the second spring end and also including a helical spring for providing the connection of the metal strip thereof to the second frame member.

* * * * *

UNITED STATES PATENT AND TRADEMARK OFFICE

CERTIFICATE OF CORRECTION

PATENT NO. : 4,657,231

DATED : April 14, 1987

INVENTOR(S) : Zygmunt M. Surletta

It is certified that error appears in the above-identified patent and that said Letters Patent is hereby corrected as shown below:

Abstract page, line 6 , "then" should read -- thence --.

Column 7, line 34 , "spring" should read -- strip --.

Column 11, line 11, claim 24 , after "first" insert -- frame --.

Signed and Sealed this

Twenty-fourth Day of May, 1988

*Attest:*

DONALD J. QUIGG

*Attesting Officer*

*Commissioner of Patents and Trademarks*